US005560299A

United States Patent [19]

Takahira

[11] Patent Number: 5,560,299

[45] Date of Patent: Oct. 1, 1996

[54] STENCIL DISCHARGING APPARATUS

[75] Inventor: Shinichi Takahira, Tokyo, Japan

[73] Assignee: Riso Kagaku Corporation, Tokyo, Japan

[21] Appl. No.: 563,595

[22] Filed: Nov. 28, 1995

[30] Foreign Application Priority Data

Nov. 28, 1994 [JP] Japan ..... 6-293256

[51] Int. Cl.[6] ..... B41F 27/00

[52] U.S. Cl. ..... 101/389.1; 101/415.1; 101/477

[58] Field of Search ..... 101/415.1, 408, 101/409, 410, 389.1, 477

[56] References Cited

U.S. PATENT DOCUMENTS

| | | | |
|---|---|---|---|
| 4,005,653 | 2/1977 | Arkell | 101/415.1 |
| 4,101,018 | 7/1978 | Sokolowaki | 101/389.1 |
| 4,237,466 | 12/1980 | Scranton | 101/389.1 |
| 4,449,452 | 5/1984 | Mansell | 101/389.1 |
| 4,878,407 | 11/1989 | Harrison et al. | 101/389.1 |
| 5,323,699 | 6/1994 | Motoe et al. | 101/477 |
| 5,377,590 | 1/1995 | Bolza-Schünemann | 101/389.1 |

*Primary Examiner*—Eugene H. Eickholt

*Attorney, Agent, or Firm*—Sughrue, Mion, Zinn, Macpeak & Seas

[57] ABSTRACT

In a rotary stencil printing machine in which a stencil sheet is wound on the outer cylindrical surface of a cylindrical printing drum, with a printing sheet held between backing means and the printing drum, printing ink is supplied from the inside of the printing drum to the printing sheet through the stencil sheet to perform a print, and the stencil discharging apparatus discharges the stencil sheet, the stencil discharging apparatus including: at least a pair of pulleys, each pulley having a axis in parallel with the axis of the printing drum; an endless belt laid over the pair of pulleys provided near the printing drum; a fan for sucking one end portion of the stencil sheet wound on the printing drum to retain the one end portion of the stencil sheet by the endless belt; and a pair of rollers dragging in the stencil sheet beginning with the one end portion retained by the endless belt with the aid of the suction means and conveyed as the endless belt is driven, and move the stencil sheet to a predetermined stencil discarding position.

6 Claims, 10 Drawing Sheets

STENCIL DISCHARGING APPARATUS

BACKGROUND OF THE INVENTION

1. Field of the Invention

This invention relates to a stencil discharging apparatus in a rotary stencil printing machine which separates a stencil sheet from the printing drum beginning with its one end, and conveys the stencil sheet thus separated into a stencil discharging container.

2. Description of Related Art

A stencil discharging apparatus which removes a stencil sheet from a printing drum, and conveys the stencil sheet thus removed into a stencil discharging container has been filed by the present Applicant under Japanese Patent Application No. Hei. 4-89385 (now Laid-Open Japanese Patent Application 5-254236). The stencil discharging apparatus is as shown in FIG. 11, and operates as follows: First, a printing stencil S is released from a clamping board 102. Under this condition, one end portion of the printing stencil thus released is separated from a printing drum 104 with a stencil separating claw 106 as the printing drum 104 turns. The one end portion thus separated is abutted against the lower surface of an endless belt 108 which is moved away from the printing drum 104, and therefore it is moved in the same direction. The one end portion thus moved is inserted between a pair of rollers 112 and 114, so that the stencil sheet is moved into a stencil disposal box 116.

The roller 112 serves as one of a pair of pulleys over which the endless belt 108 is laid. The endless belt 108 laid over a pulley 110 and the pulley 112, the pulley 110, and the rotary shaft of the pulley 110 are all pivotable about the rotary shaft 112*a* of the pulley 112. In a stencil discharging operation; that is, when it is required to remove a printing stencil from the printing drum, the pulley 110 is positioned adjacent to the printing drum 104 as shown in FIG. 11. In contrast, when it is not required to remove a printing stencil from the printing drum, the pulley 110 is pivoted upwardly about the shaft 112*a*, thus being positioned away from the printing drum 104.

With the above-described stencil discharging apparatus, the stencil S separated from the printing drum with the stencil separating claw is inserted between the rollers 112 and 114, and moved into the stencil disposal box 116. However, the stencil discharging apparatus suffers from the following problem: That is, a stencil sheet is sometimes curled depending on its nature, curling tendency, ambient temperature, ambient humidity, static electricity, etc. Especially when the stencil sheet is curled downwardly, the front end portion of the stencil sheet may enter the gap between the stencil separating claw and the printing drum, thus not reaching the pair of rollers. In this case, the stencil sheet cannot be moved into the stencil disposal box.

SUMMARY OF THE INVENTION

In view of the foregoing, an object of the invention is to provide a stencil discharging apparatus for a stencil printing machine which, no matter how the front end portion of the stencil sheet curls, is able to positively separate the stencil sheet from the printing drum and to convey the stencil sheet thus separated into the stencil disposal box.

According to a first aspect of the present invention, there is provided a stencil discharging apparatus for a rotary stencil printing machine in which a stencil sheet is wound on the outer cylindrical surface of a cylindrical printing drum, with a printing sheet held between backing means and the printing drum, printing ink is supplied from the inside of the printing drum to the printing sheet through the printing stencil to perform a print, and the stencil discharging apparatus discharges the stencil sheet, the stencil discharging apparatus comprising: at least a pair of pulleys, each pulley having a axis in parallel with the axis of the printing drum; an endless belt laid over the pair of pulleys provided near the printing drum; suction means for sucking one end portion of the stencil sheet wound on the printing drum to retain the one end portion of the stencil sheet by the endless belt; and a pair of rollers dragging in the stencil sheet beginning with the one end portion retained by the endless belt with the aid of the suction means and conveyed as the endless belt is driven, and move the stencil sheet to a predetermined stencil discarding position.

According to a second aspect, there is provided the stencil discharging apparatus of the first aspect, wherein the endless belt is driven to move to and from the printing drum.

According to a third aspect, there is provided the stencil discharging apparatus of the first aspect, further comprising: locking means provided on the outer cylindrical surface of the printing drum, for locking the one end portion of the stencil sheet; and a thin elastic piece provided near the locking means for, when the one portion of the stencil sheet is released from the locking means, moving the one end portion of the stencil sheet away from the printing drum.

One end portion of the stencil sheet wound on the printing drum, being sucked by the suction means, is retained by the endless belts. As the endless belts are driven, the stencil sheet whose one end portion has been retained by the endless belts is conveyed towards pairs of rollers and inserted between those rollers. As the rollers are driven, the stencil sheet is separated from the printing drum, and then moved to a predetermined stencil discarding position.

DETAILED DESCRIPTION OF THE PREFERRED EMBODIMENTS

A stencil discharging apparatus for a rotary stencil printing machine according to the present invention will be described with reference to FIGS. 1 through 10.

Figure 1:
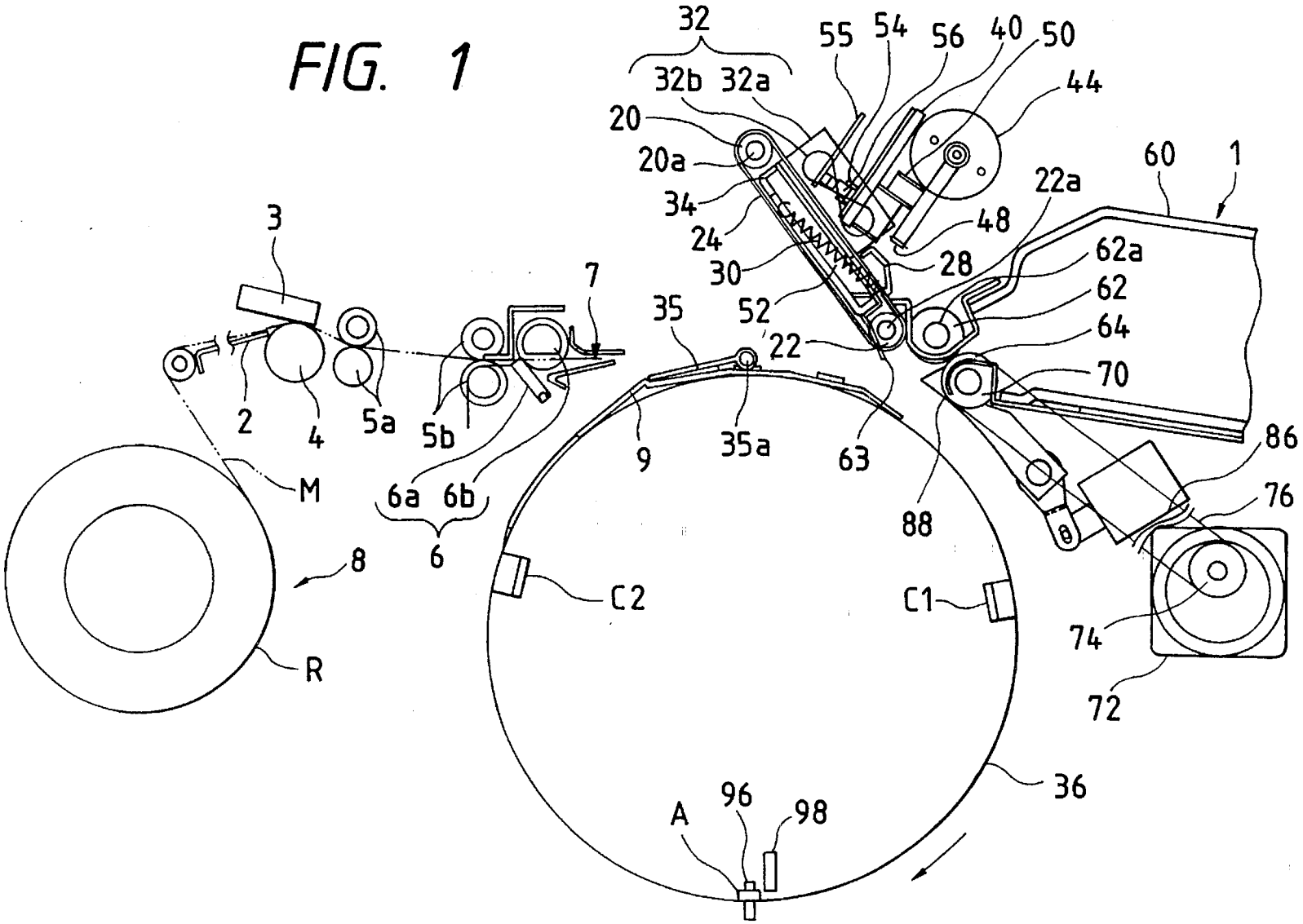
FIG. 1 is a sectional view of a stencil printing machine with a stencil discharging apparatus according to the present invention.

The stencil discharging apparatus 1 is provided for a rotary stencil printing machine of the type in which a stencil sheet is made. The stencil discharging apparatus 1 operates to remove a used stencil sheet M from the printing drum 36 of the printing machine, and discard the stencil M thus removed. As shown in FIG. 1, the rotary stencil printing machine has a stencil making section which includes: a stencil paper guiding lower board 2; a thermal head 3 for thermally perforating a stencil sheet to obtain a stencil sheet; a platen roller 4 positioned below the thermal head 3; a pair of stencil sheet conveying rollers 5*a* and 5*b;* a stencil sheet cutter 6 including a stationary blade 6*a* and a movable blade 6*b* positioned above the stationary blade 6*a;* and a stencil go-out path 7 which is defined by a stencil paper guide board and a stencil paper guiding upper board.

As shown in FIG. 1, a rolled-stencil holding section 8 is provided on the left side of the stencil forming section. The section 8 holds a roll R of a heat-sensitive stencil sheet M. The stencil sheet M is conveyed out of the rolled-stencil holding section 8 by the stencil sheet conveying rollers 5*a* and 5*b* in the stencil making section, and thermally perforated with the thermal head 3 to make a stencil sheet. The stencil sheet M thus processed is cut with the cutter 6 to obtain the stencil sheet.

The stencil thus obtained is wound on the printing drum 36. The printing drum 36 is rotatable on its own central axis, and is rotated clockwise (in FIG. 1) by a main motor (not shown). The cylindrical wall of the printing drum 36 includes a printing region which is ink-permeable. Ink supplying means (not shown) is provided inside the printing drum, to supply printing ink to the inner cylindrical surface of the printing drum 36.

The remaining region of the cylindrical wall of the printing drum 36, which is not ink-permeable, has a stage member 9 on its outer surface in such a manner that the stage member 9 extends along the central axis of the printing drum 36. A stencil clamping board 35 is pivotably mounted on the stage member 9. The stencil clamping board 35 is pivoted by a driving unit (not shown), to cooperate with the stage member 9 to clamp one end portion of the stencil.

The rotary stencil printing machine further includes: an original reading section (not shown) which reads the image of an original to form a stencil sheet; a sheet supplying section (not shown) which supplies a printing sheet to the printing drum 36 on which the stencil sheet has been wound; a press roller (not shown) which presses the printing sheet against the printing drum 36 which has been supplied to the latter 36 by the sheet supplying section, thereby to transfer the printing ink onto the printing sheet; i.e., to obtain a print; and sheet discharging section (not shown) which separates the printing sheet (or the print) from the printing drum and conveys it to a predetermined position; and the stencil discharging apparatus 1 which separates the used stencil sheet from the printing drum 36 and discard it.

Now, the arrangement of the stencil discharging apparatus 1 will be described in detail.

As shown in FIGS. 1 through 7, two boxes 34 are coupled to each other through a coupling board 38. Those boxes 34 are opened upwardly. The lower surfaces of the boxes 34, which are on the side of the printing drum 36, have each suction holes 34*a* at two positions. Supporting boards 26 are provided on both sides of each of the boxes 34. More specifically, each of the boxes 34 has one outer supporting board 26 and one inner supporting board 26 respectively on its both sides. The front and rear end portions of the two outer supporting boards 26 protrude from the front and rear end portions of the boxes 34, respectively. The coupling board 38 is coupled to the two inner supporting boards 26 so that the two boxes 34 are coupled to each other.

One shaft 20*a* is rotatably supported by the front end portions of the two outer supporting boards 26. Four pulleys 20 are mounted on the shaft 20*a,* in such a manner that two pulleys 20 are provided for each of the boxes 34. One shaft 22*a* is supported by the rear end portions of the two supporting boards 26 of each of the boxes 34 (i.e., two shafts 22*a* are provided for the two boxes 34). Two pulleys 22 are mounted on each of the shafts 22*a.* That is, in total, four pulleys 22 are provided in correspondence to the aforementioned pulleys 20; that is, four pairs of pulleys 20 and 22 are provided. Four endless belts 24 are laid over the four pairs of pulleys 20 and 22, respectively.

Figure 7:
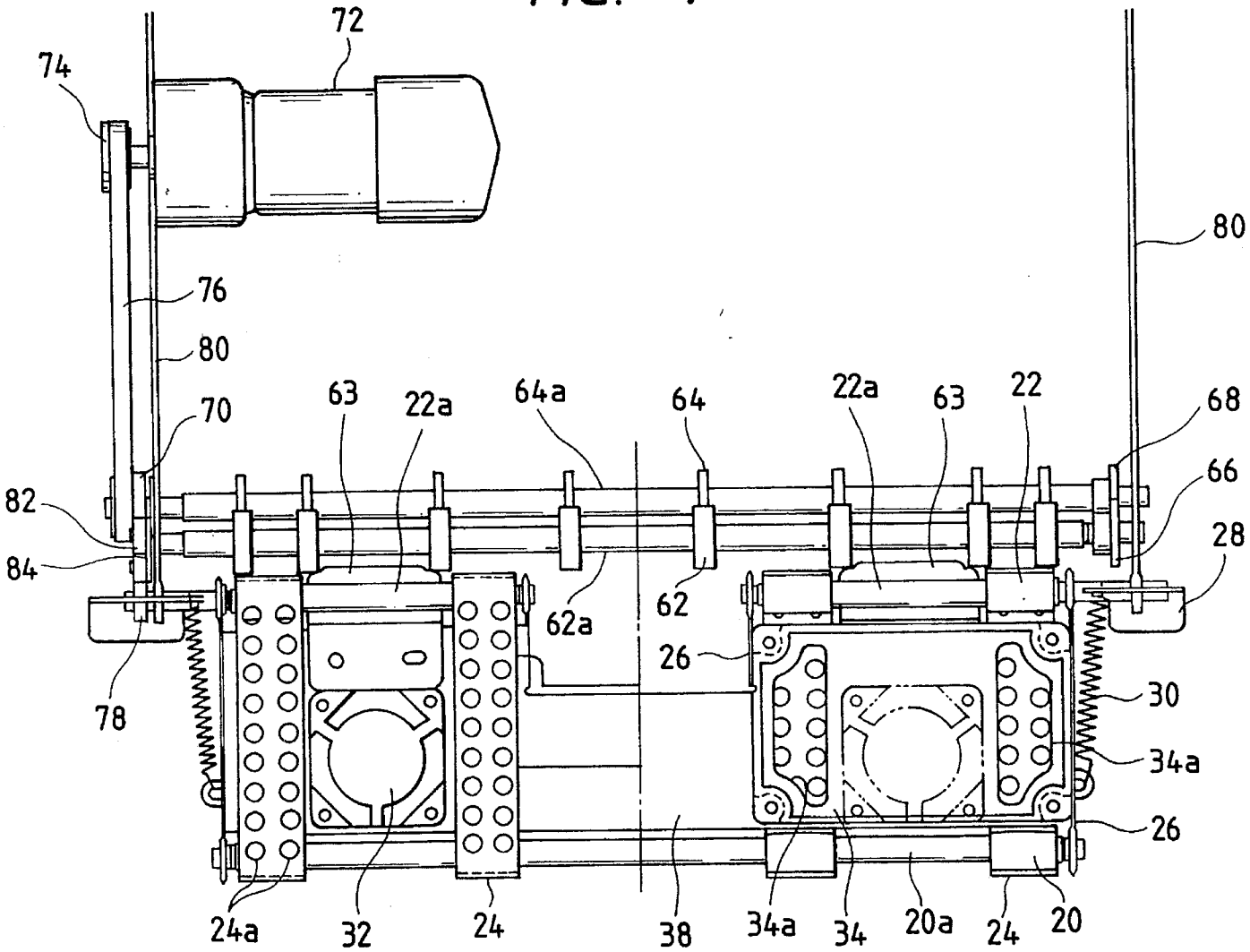
FIG. 7 is a plan view, with parts cut away, showing the endless belt driving mechanism of the invention.

The right half of FIG. 7 shows the box 34 and its relevant components, with the upper halves of the endless belts removed for explanations. As shown in FIG. 7, the endless belts 24 are confronted with the suction holes 34*a* formed in the lower surfaces of the boxes 34, respectively. Each of the endless belts 24 has a number of holes 24*a* in its entirety. That is, the insides of the boxes 34 are communicated with the outside air through the suction holes 34*a* of the boxes 34 and the holes 24*a* of the endless belts 24.

The outer end portions of the shafts 22*a* are rotatably supported by stationary base boards 80 of the stencil discharging apparatus. Hence, the endless belts 24, the pulleys 20, and the shafts 20*a* of the pulleys 20, are pivotable about the shafts 22*a* of the other pulleys 22 which are supported by the stationary base boards 80. Two springs 30 are interposed between the two outer supporting boards 26 and stationary base boards 28 secured to the stationary base boards 80, so that the endless belts 24, and the pulleys 20 including the shafts 20*a* are urged clockwise in FIG. 1.

Figure 6:
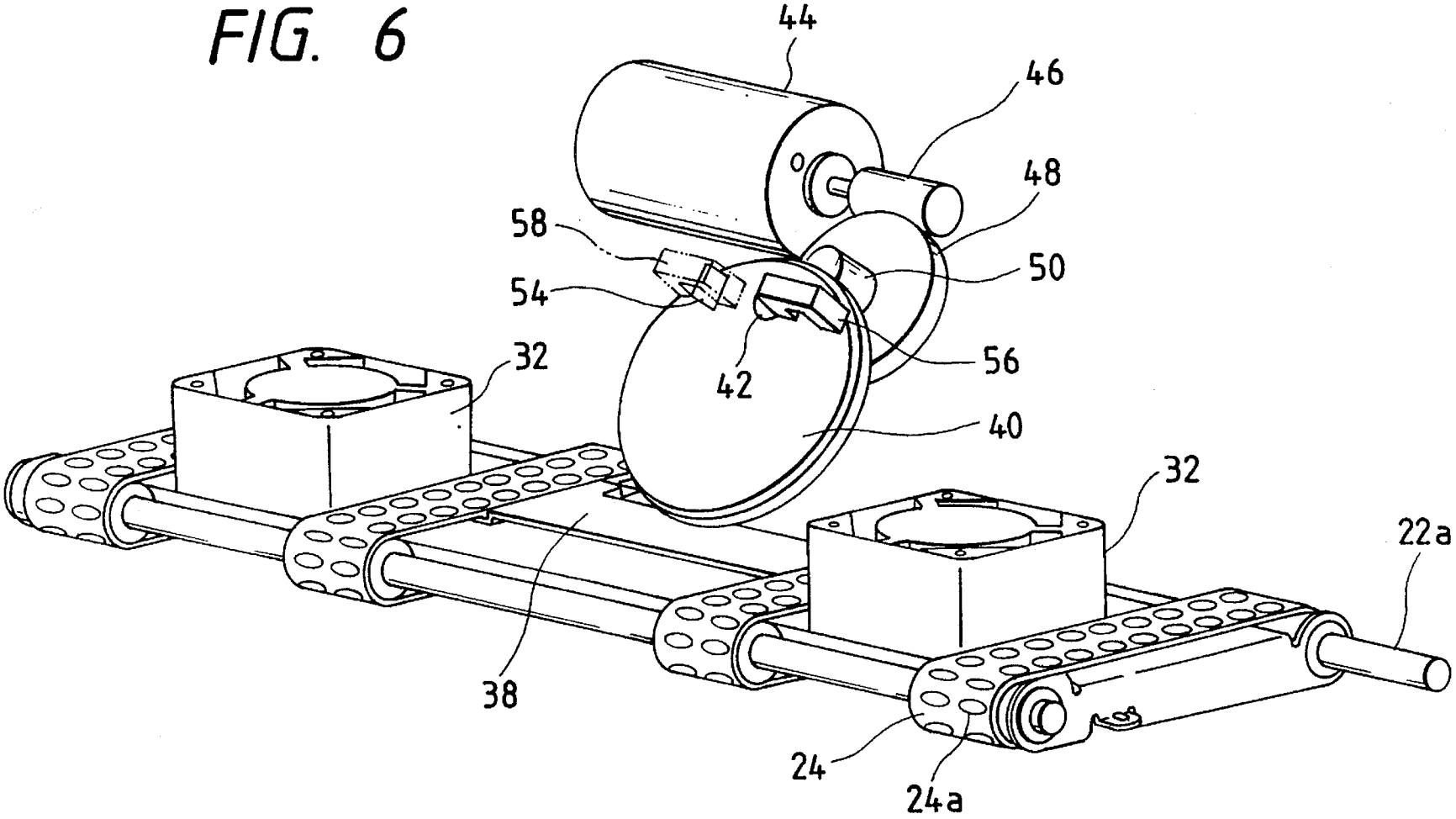
FIG. 6 is a perspective view of an endless belt swinging mechanism of the invention.

As shown in FIGS. 1, 6 and 7, the boxes 34 have suction means 32, respectively. Each of the suction means 32 includes: a housing 32*a* mounted on the opening formed in the upper surface of the respective box 34; and a fan 32*b* provided inside the housing 32*a* to suck the air inside the housing 32*a*. The housing 32*a* closes the opening formed in the upper surface of the box 34. As was described before, the suction holes 34*a* formed in the lower surface of the box 34 are confronted through the holes 24*a* of the endless belts 24 with the outside of the box 34. When, in each of the housings 32, the fan 32*b* is turned, a stream of air is formed which flows from the outside of the box 34 through the suction holes 34*a* to the fan 32*b* in the housing 32*a*. Hence, the stencil sheet M located below the endless belts 24 is sucked towards the endless belts 24 with the aid of the stream of air thus formed, thus being retained by the endless belts 24.

A mechanism for swinging the endless belts 24 etc. about the shaft 22*a* will be described with reference mainly to FIGS. 1, 6, 8 and 9.

Above the coupling board 38, a cam plate 40 is rotatably mounted on a shaft 42. The cam plate 40 is a circular board, and has the shaft 42 which is located away from the center of the cam plate 40. A stencil discharging guide motor 44 is fixedly mounted on a stationary member (not shown). A worm 46 is fixedly mounted on the output shaft of the motor 44, and is engaged with a worm wheel 48 which is rotatably mounted on a stationary member (not shown). The worm wheel 48 is integral with a gear 50, which is engaged with a gear 52 which is fixedly mounted on the shaft 42 of the cam plate 40. Hence, as the motor 44 is driven, the cam plate 40 is rotated around the eccentric shaft 42.

Figure 8:
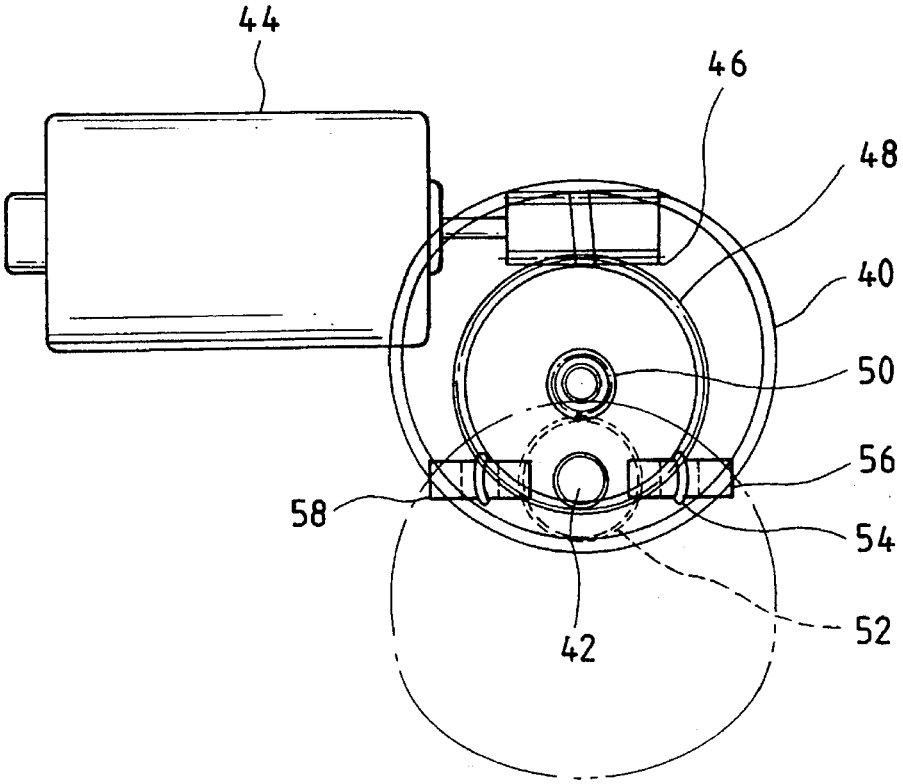
FIG. 8 is a diagram of the endless belt swinging mechanism, as viewed in the direction of axis of a cam plate.
Figure 9:
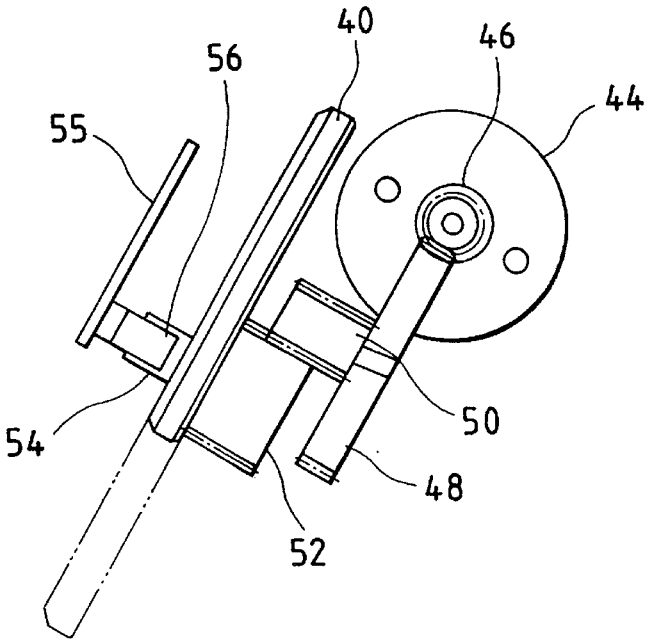
FIG. 9 is a right side view of the endless belt swinging mechanism shown in FIG. 8.

As shown in FIGS. 6, 8 and 9, a protrusion 54 extends from the surface of the cam plate 40 which is opposite to the surface on which the gear 52 is provided. A substantially U-shaped stencil-discharging HP sensor 56, and a stencil-discharging guide sensor 58 are provided on a stationary base board 55 (shown in FIG. 9) in correspondence to two positions on the locus of the protrusions 54. Those sensors 56 and 58, and the protrusion 54 are to detect the position of the cam plate 40. The stationary base board 55 is fixedly mounted on a stationary member (not shown).

When, as shown in FIG. 1, the protrusion 54 is at the position of the stencil-discharging HP sensor 56, the cam plate 40 is at the home position, and the endless belts 24 are at the uppermost position, being urged by the springs 30. When, as shown in FIG. 6, the protrusion 54 is at the position of the stencil-discharging guide sensor 58, the cam plate 40 depresses the coupling board 38, so that the endless belts 24 are depressed to the lowermost position against the elastic forces of the springs 30, thus being set close to the printing drum 36.

Pairs of rollers 62 and 64 are provided adjacent to the pulleys 22; more specifically, those rollers 62 and 64 are arranged at the inlet of a stencil disposal box 60. The rollers 62 and 64 are turned in the opposite directions, to move into the stencil disposal box 60 a stencil sheet M which is conveyed thereto by the endless belts 24 and the suction means 32. The roller 62 is made of an elastic material such as rubber, and the roller 64 is in the form of a gear made of a rigid material.

A mechanism for driving the rollers 62 and 64, and the endless belts 24 will be described with reference to FIGS. 1, 5, 6 and 7.

As shown in FIG. 7, the rollers 62 are mounted on a shaft 62*a*, and the rollers 64 are mounted on a shaft 64*a*. A gear 66 is mounted on one end portion of the shaft 62*a*, and a gear 68 is mounted on one end portion of the shaft 64*a*, in such a manner that those gears 66 and 68 are engaged with each other. A gear 70 is mounted on the other end portion of the shaft 64*a*. An endless belt 76 is laid over the gear 70 and a pulley 74 which is mounted on the output shaft of a stencil-discharging longitudinal-feed motor 72. Hence, as the motor 72 is driven, the pairs of rollers 62 and 64 are turned in the opposite directions.

Figure 5:
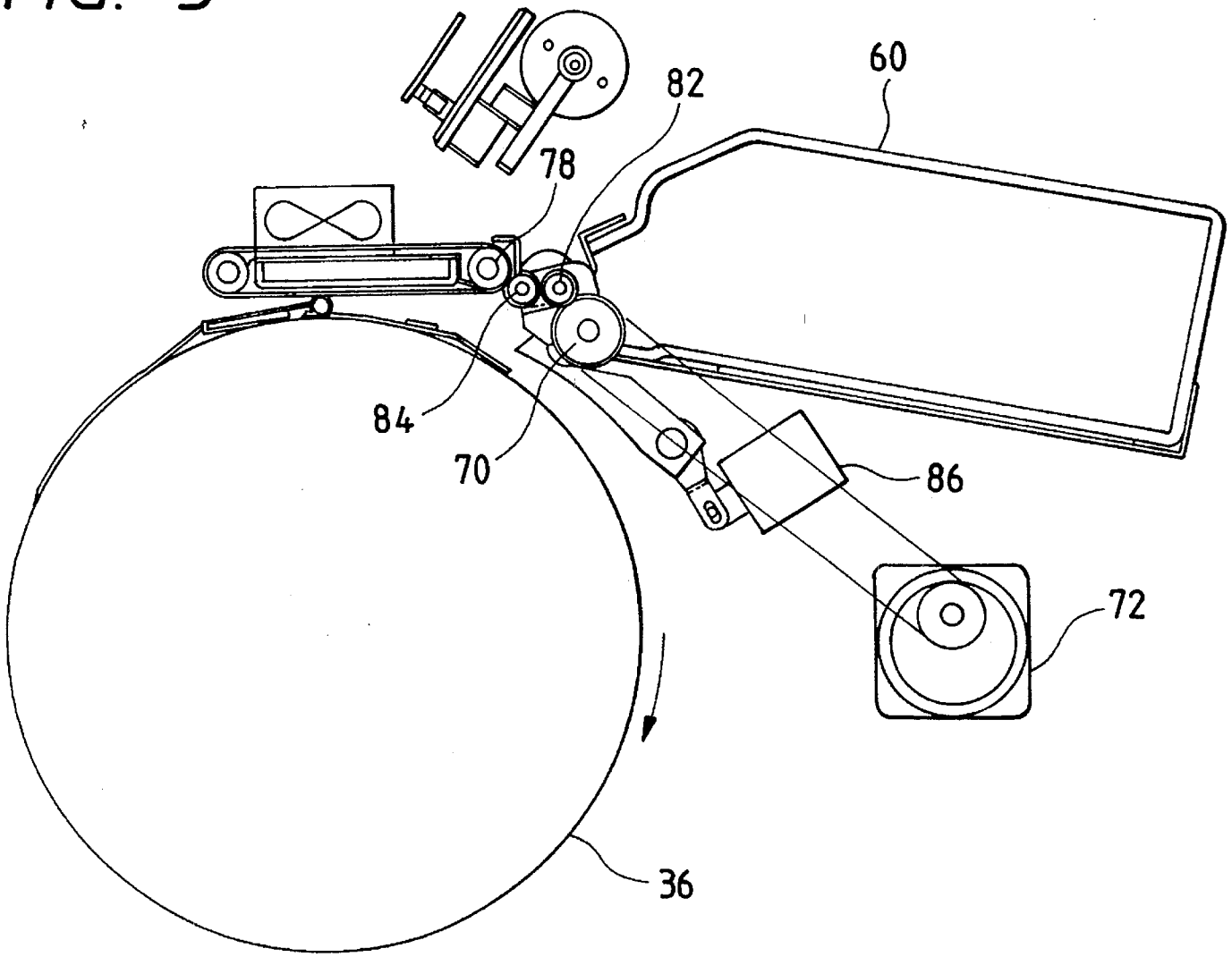
FIG. 5 is a diagram showing an endless belt driving mechanism of the invention.

As shown in FIG. 7, a gear 78 is mounted on one end portion of one of the two shafts 22*a*, and gears 82 and 84 are rotatably provided on the stationary base board 80. As shown in FIGS. 5 and 7, the gears 70, 82, 84 and 78 are engaged with one another, so that the shaft 22*a* is turned in synchronization with the driving of the motor 72, to drive the endless belts 24.

Figure 4:
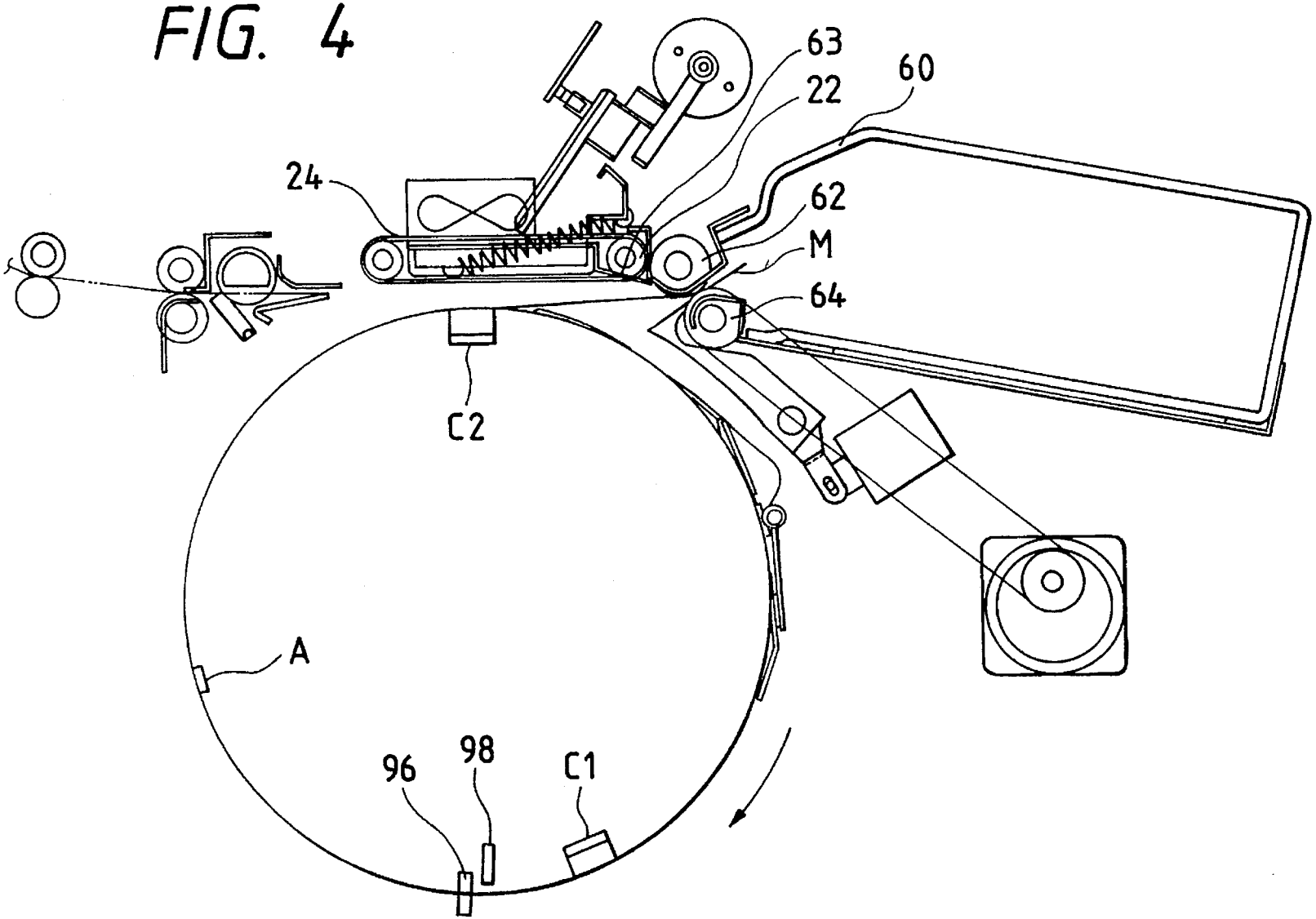

The housing 32*a* of each of the suction means 32 has a guide board 63 on the side of the rollers 62. When the stencil sheet M is conveyed by the endless belts 24 set close to the printing drum 36 as shown in FIG. 4, the guide boards 63 are positioned between the shaft 22*a* and the shaft 62*a* to prevent the front end of the stencil sheet from being inserted between the pulleys 22 and the rollers 62.

As shown in FIG. 1, a sheet separating claw 88 is provided below the gear 70. The sheet separating pawl 88 is driven by a claw solenoid 86 so that it is moved between a first position close to the printing drum 36 and a second position spaced away from the printing drum 36.

As shown in FIG. 1, three position detecting boards A, C1 and C2 are provided inside the printing drum at predetermined angular intervals. An A detection sensor 96 and a C detection sensor 98 are provided outside the drum 36 at predetermined positions. Each of those sensors 96 and 98 includes a light emitting element, and a light receiving element, and outputs a detection signal upon interruption of the optical path between those elements. The position detecting board A is detected by the A detection sensor 96. Hereinafter, the angular position which the printing drum 36 takes when the position detecting board A is detected by the A detection sensor 96 will be referred to as "an A detection position" when applicable. The position detecting boards C1 and C2 are detected by the C detection sensor 96. Hereinafter, the angular positions which the printing drums takes when the position detecting boards C1 and C2 are detected by the C detection sensor, will be referred to as "a C1 detection position" and "a C2 detection position", respectively, when applicable.

Figure 2:
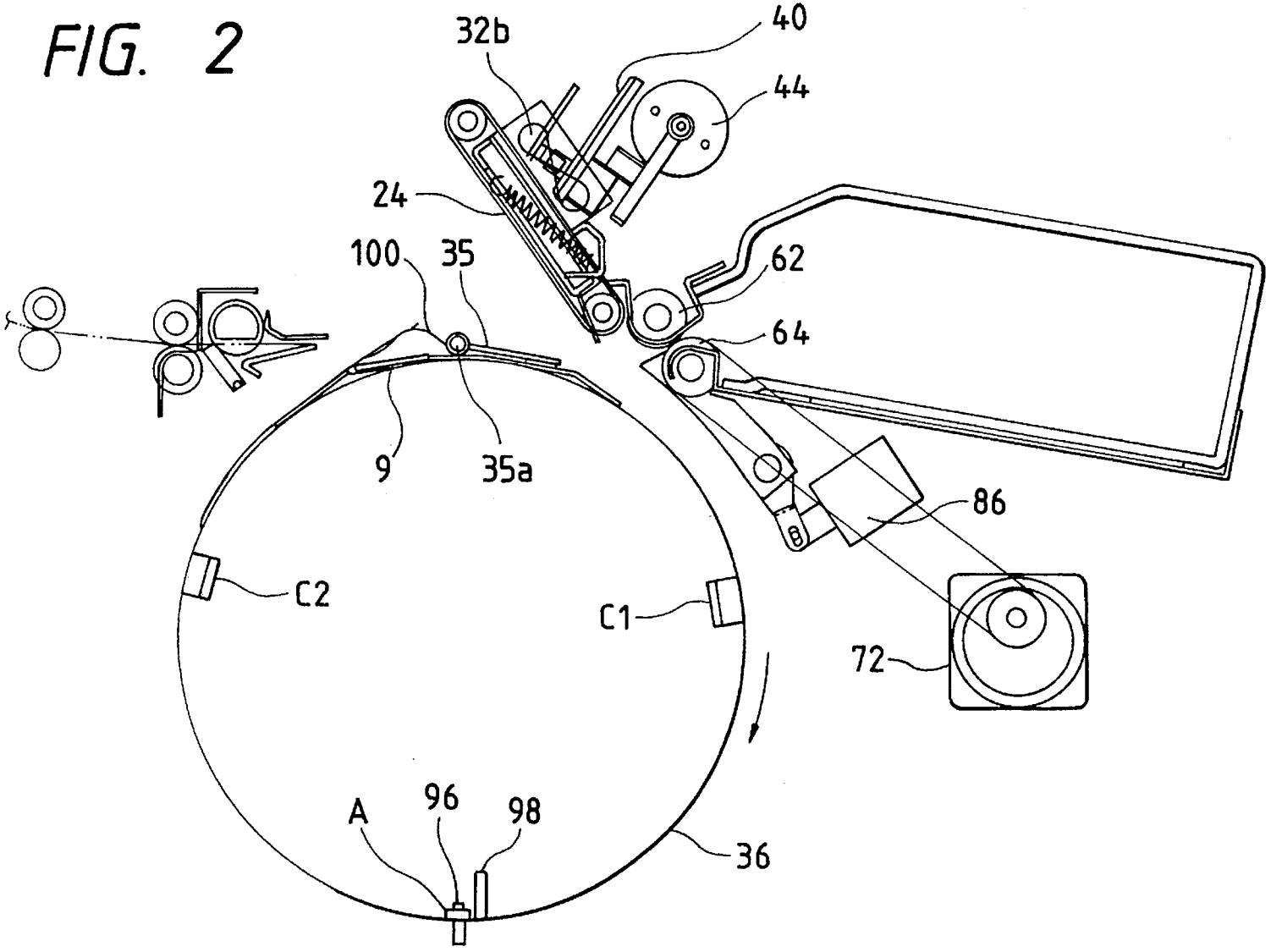
FIGS. 2, 3 and 4 are diagrams for a description of the stencil discharging operation of the stencil discharging apparatus.
Figure 10:
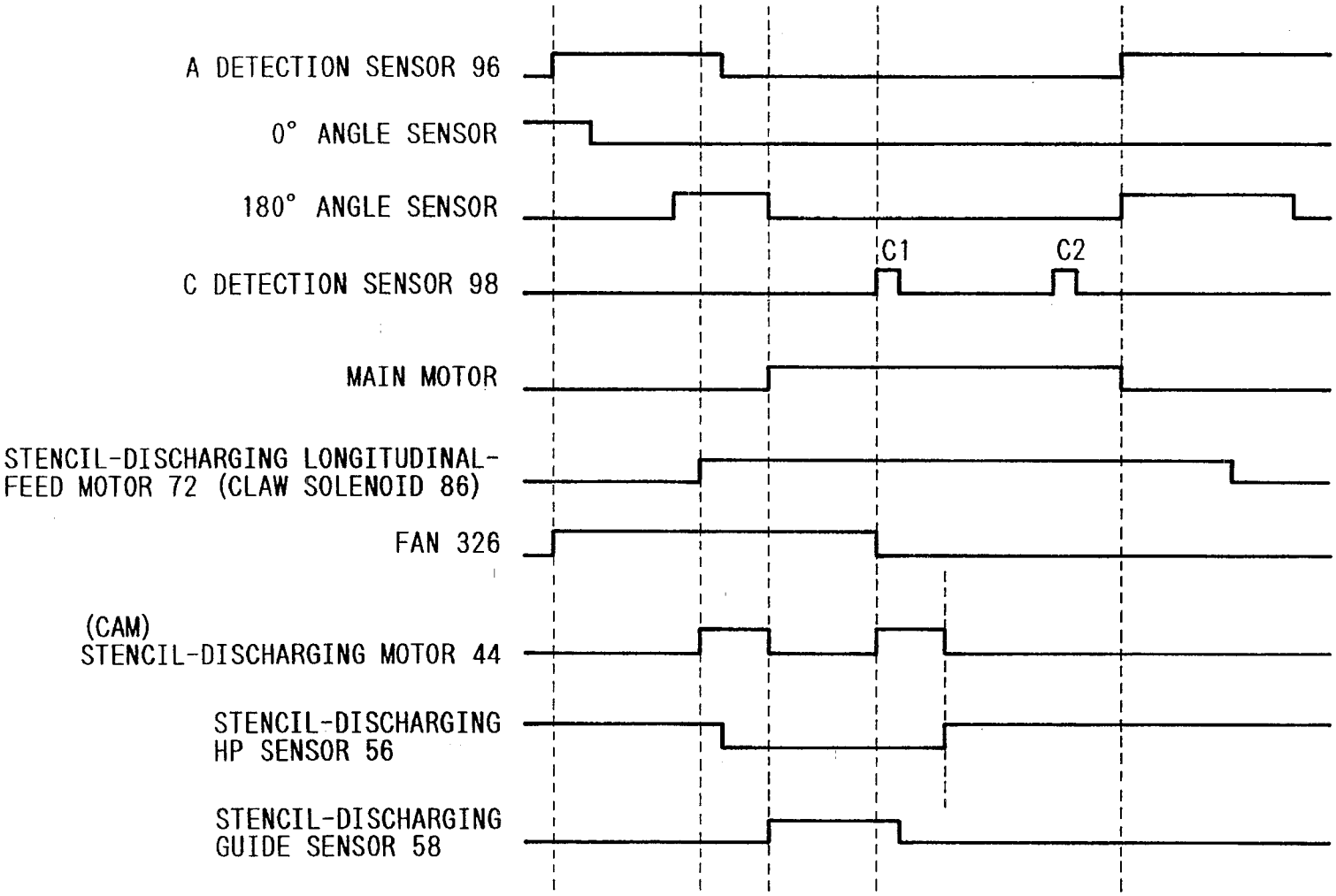
FIG. 10 is a time chart for a description of the stencil discharging operation of the stencil discharging apparatus.
Figure 11:
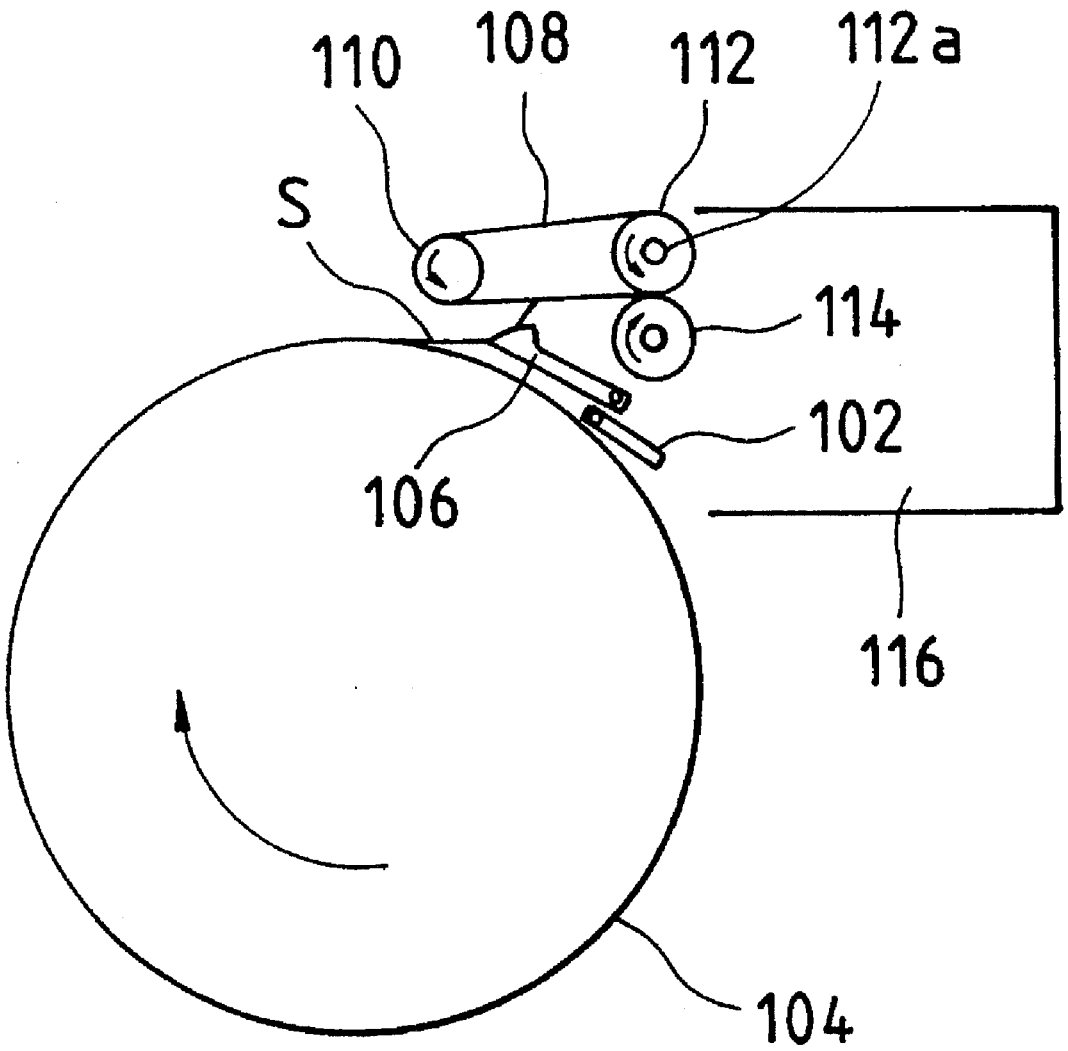
FIG. 11 is a side view outlining an example of a conventional stencil discharging apparatus.

The operation of the stencil discharging apparatus will be described with reference mainly to FIG. 10, a time chart, and FIGS. 2, 3 and 4, operating diagrams. In FIG. 10, a 0° angle sensor is to detect the fact that the clamping board 35 is closed (0°), and a 180° angle sensor is to detect the fact that the clamping board 35 is opened (180°). The timing of driving the stencil-discharging longitudinal feed motor 72 is the same as that of driving the claw solenoid 86.

When the printing drum is turned to locate the shaft 35*a* of the clamping board 35 substantially at the top of the drum, the A detection sensor 96 detects the position detecting board A; that is, the A detection position of the printing drum 36 is detected. Upon detection of the A detection position, the fans 32*b* are turned, so that the clamping board 35 is opened by a drive unit (not shown). The fact that the clamping board 35 is opened is detected by the 180° sensor (not shown).

A thin elastic piece 100 is provided on the stage member 9 of the printing drum 36. The thin elastic piece 100 has been invented by the present Applicant, and it is similar to the one which has been disclosed under European Patent No. 179986 and U.S. Pat. No. 4,587,900. That is, the thin elastic piece 100 is made of a polyester sheet or carbon fiber sheet about 0.5 to 0.05 mm in thickness. One end portion of the thin elastic piece 100 is secured to the stage member 9, while the other end portion is fixedly wound on the shaft 35*a* of the clamping board 35. When the clamping board 35 is closed, the thin elastic piece 100 is held between the clamping board 35 and the stage member 9; however, when the clamping board 35 is opened, the thin elastic piece 100 is raised above the stage 9 to push the front end portion of the stencil sheet upwardly which is held between the piece 100 and the board 35.

Thereafter, the stencil-discharging longitudinal feed motor 72, and the stencil-discharging guide motor 44 start, and the claw solenoid 86 is driven. The motor 72 turns the rollers 62 and 64, and the endless belts 24. The motor 44 turns the cam plate 40 until the stencil-discharge guide sensor 58 detects the protrusion 54, so that the endless belts 24 are set closest to the printing drum 36 as shown in FIGS. 3 and 6. The claw solenoid 86 sets the sheet separating claw 88 close to the printing drum 36 as shown in FIG. 3.

Figure 3:
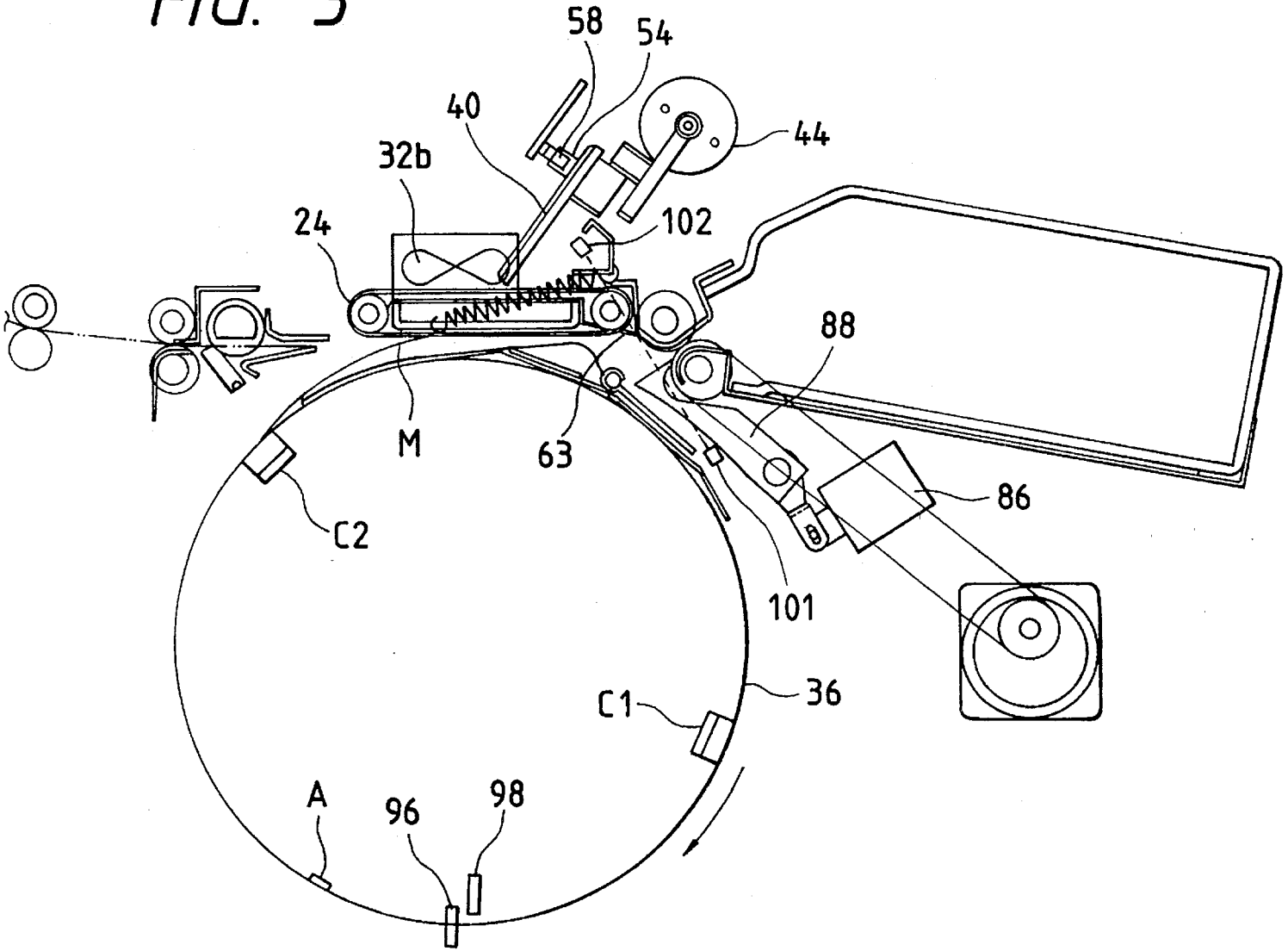

In response to a detection signal outputted by the stencil-discharging guide sensor 58, the stencil-discharging guide motor 44 is stopped, and at the same time the main motor (not shown) is driven to turn the printing drum as shown in FIG. 3. Simultaneously when the endless belts 24, being moved downwardly, come near the printing drum 36, the front end portion of the stencil wound on the printing drum 36, being sucked by the fans 32*b*, is retained by the endless belts 24.

Hence, as the endless belts 24 are driven, the stencil sheet M is conveyed towards the rollers 62 and 64 by the endless belts 24 as shown in FIG. 4, so that its front end portion is inserted between the rollers 62 and 64. In this operation, the front end portion of the stencil sheet will never enter the spaces between the shafts 22*a* of the pulleys 22 and the shaft 62*a* of the rollers 62, because the guide boards 63 have been set in those spaces. Thus, the stencil sheet M is conveyed by the rollers 62 and 64, thus finally being put in the stencil disposal box 60.

When the printing drum 36 is turned to the C1 position, the fans 32*b* are stopped, and at the same time the motor 44 is started. The motor 44 turns the cam plate 40 until the stencil-discharging HP sensor 56 detects the protrusion 64, and stops when the endless belts 24 are moved to the home position farthest from the printing drum.

When the printing drum 36 turns to the A detection position, the main motor is stopped. Thereafter, under the condition that a stencil jamming sensor 101 (shown in FIG. 3) determines that no stencil sheet is jammed, the rotation of stencil-discharging feed motor 72 and the driving of the claw solenoid 86 are stopped. Thus, the stencil discharging operation has been ended.

As is apparent from the above description, with the stencil discharging apparatus of the invention, no matter how the front end portion of the stencil sheet curls which is wound on the printing drum, the front end portion can be positively seized, so that the stencil sheet can be positively removed from the printing drum and conveyed into the stencil disposal box.

What is claimed is:

1. A stencil discharging apparatus for a rotary stencil printing machine in which a stencil sheet is wound on the outer cylindrical surface of a cylindrical printing drum, with a printing sheet held between backing means and the printing drum, printing ink is supplied from the inside of the printing drum to the printing sheet through the stencil sheet to perform a print, and said stencil discharging apparatus discharges the stencil sheet, said stencil discharging apparatus comprising:

at least a pair of pulleys, each pulley having a axis in parallel with the axis of the printing drum;

an endless belt laid over said pair of pulleys provided near the printing drum;

suction means for sucking one end portion of the stencil sheet wound on the printing drum to retain the one end portion of the stencil sheet by said endless belt; and a pair of rollers dragging in the stencil sheet beginning with the one end portion retained by said endless belt with the aid of said suction means and conveyed as said endless belt is driven, and move the stencil sheet to a predetermined stencil discarding position.

2. A stencil discharging apparatus according to claim 1, wherein said endless belt is driven to move to and from said printing drum.

3. A stencil discharging apparatus according to claim 1, further comprising:

locking means provided on the outer cylindrical surface of the printing drum, for locking the one end portion of the stencil sheet; and a thin elastic piece provided near said locking means for, when the one portion of the stencil sheet is released from said locking means, moving the one end portion of the stencil sheet away from the printing drum.

4. A stencil discharging apparatus according to claim 1, wherein said endless belt has a plurality of holes.

5. A stencil discharging apparatus according to claim 1, further comprising:

a stencil discharging guide motor;

a cam shaft driven by said stencil discharging guide motor;

a cam plate having a disk shape, said cam plate being driven by said cam shaft fixed eccentric thereon;

a first shaft rotatably supporting one of said pair of pulleys;

a coupling board urged by said cam plate, said coupling board being connected with said suction means and said first shaft; and a second shaft rotatably supported by the stencil printing machine, said second shaft rotatably supporting the other of said pair of pulleys, wherein said one of said pair of pulleys, said endless belt, said suction means, said first shaft and said coupling board are pivoted about said second shaft as one unit by said cam plate.

6. A stencil discharging apparatus according to claim 1, wherein said suction means comprising:

a box inserted between a space defined by said endless belt and said pair of pulley, said box having an opening at top and a hole near said endless belt; and a fan positioned above said opening of said box.

* * * * *